US005623991A

United States Patent [19]

Jani

[11] Patent Number: 5,623,991

[45] Date of Patent: Apr. 29, 1997

[54] TUBING TIGHTENER

[75] Inventor: William Jani, Calgary, Canada

[73] Assignee: Northwest Tech Group Inc., Calgary, Canada

[21] Appl. No.: 568,199

[22] Filed: Dec. 6, 1995

[51] Int. Cl.[6] ..... E21B 23/00

[52] U.S. Cl. ..... 166/216; 166/217

[58] Field of Search ..... 166/117.7, 210, 166/216, 217, 243; 81/443, 448; 294/86.25

[56] References Cited

U.S. PATENT DOCUMENTS

| | | | |
|---|---|---|---|
| 1,617,303 | 2/1927 | Dougherty | 166/117.7 |
| 2,038,262 | 4/1936 | Bernhardt | 81/448 |
| 2,665,888 | 1/1954 | Claypool et al. | 166/117.7 |
| 3,296,900 | 1/1967 | Behnke | 81/448 |
| 3,322,006 | 5/1967 | Brown | 166/117.7 X |
| 3,380,528 | 4/1968 | Timmons | 166/117.7 X |
| 4,499,799 | 2/1985 | Bordages | 81/443 X |
| 5,275,239 | 1/1994 | Obrejanu | 166/210 |

FOREIGN PATENT DOCUMENTS 1274470 9/1990 Canada .

*Primary Examiner*—Hoang C. Dang

*Attorney, Agent, or Firm*—Van Dyke, Gardner, Linn & Burkhart, LLP

[57] ABSTRACT

A tubing tightener which is readily adaptable to either clockwise or anti-clockwise rotational setting operation and which uses a series of drag slips having integral drag and slip surface regions. The drag surface regions are substantially smooth and are advanced into contact with a wellbore with the slip surface regions retracted, when the tightener is in its unlocked orientation. The slip surface regions are serrated to provide a positive engagement with the wellbore and are advanced into engagement with the wellbore with the drag surface regions retracted, when the tightener is in its locked orientation. The drag slips are caused to rock about a point of contact between the drag slip surfaces and the wellbore, located intermediate the drag and slip surface regions, in order to advance the appropriate surface region of each drag slip into engagement with the wellbore. The invention provides for a compact, lightweight construction with improved reliability and increased bypass around the tightener.

18 Claims, 4 Drawing Sheets

TUBING TIGHTENER

BACKGROUND OF THE INVENTION

1. Field of the Invention

This invention relates to a tube tightener for downhole use in production and exploration wells.

2. Description of the Prior Art

After a string of tubing is run down a wellbore, it requires to be tightened so that the tubing is securely and centrally located in the bore. It can also happen that the tubing becomes loose after it has been in the well for a length of time, due to the action of downhole pumps or other equipment to which the tightener is attached, which also requires that the tubing string be tightened. A wide variety of tubing anchors have been proposed for this purpose, such anchors using slips which are forced outwardly into gripping engagement with the wellbore once the tubing string is in position. Some devices use a threaded rotation of the tubing string to set the slips but this can be difficult or impossible to release for withdrawal or re-location of the tubing string. Drilling or fishing operations then become necessary to remove the anchor. Other methods use a cone arrangement with a shear system to set the slips, but this often results in shearing of the tool due to the force exerted on the cone. Also, the anchors tends to become contaminated with sand during normal operation in the wellbore and release of the anchor for removal or relocation of the tubing string then becomes difficult or impossible.

One attempt to overcome the foregoing problems is described in Canadian Patent No. 1,274,470 (Weber). Weber's approach is to use slips extending radially outwardly through apertures in a slip casing and biased radially inwardly (i.e. away from the wellbore surface) by means of springs. An inner mandrel is connected for rotation with a tubing string and has on its outer surface a series of cams which can be rotated into engagement with the rear surface of the slips by rotation of the inner mandrel, which forces the slips outwardly against the force of the springs into engagement with the wellbore surface. The rotation of the inner mandrel to set the anchor is effected by rotating the tubing string. The slips have vertically extending teeth which bite into the wellbore surface and lock the anchor in position. In order to restrain the slips from rotating with the inner mandrel during the setting operation, which would prevent the necessary relative movement between the cams and the slips, a drag block casing is secured to the slip casing and is provided with a number of drag blocks, which are biased outwardly by springs into engagement with the wellbore surface. These drag blocks restrain rotational movement but permit vertical movement of the anchor and tubing string.

However, there are a number of drawbacks to the Weber device, which the present invention seeks to overcome. The Weber device is primarily designed for operation with a screw-type pump in which the pump operates by rotating the rod string to the right when viewed from its upper end. Thus, the device is also designed to be set by rotating the inner mandrel to the right (i.e., clockwise) and released by rotating anti-clockwise. However, there are many other situations where the tubing tightener should be manipulated in the opposite direction but the Weber tool does not provide flexibility in that regard. Furthermore, the Weber device is unnecessarily complex and unwieldy in that it employs separate slips and drag blocks. This decreases the bypass around the tool.

It would therefore be desirable to provide a tubing tightener which can easily be adapted to either clockwise or anti-clockwise setting, depending upon user requirements. It would also be desirable that the slips and drag blocks be integrated in order to increase the bypass around the tool and reduce the weight and length of the device, it being noted that increased weight and length can make removal or relocation of the device more difficult.

BROAD SUMMARY OF THE INVENTION

The purpose of the present invention is to provide a mechanism which will permit the tubing to be securely tightened in the well bore, either during running of the tubing string or for the purpose of tightening the string after it has been in the well for a period of time, and which avoids the problems experienced with conventional tube tighteners described above, including the Weber device. The tube tightener may be used at wellbore locations where either the bore has a casing or is uncased. By very simple disassembly and reassembly before use, the tool can be adapted to either clockwise or anti-clockwise setting. The slips are integrated rather than being separate units, which saves weight and size and provides for greatly enhanced reliability as well as increased bypass.

Thus, according to the invention, there is provided a tubing tightener adapted for insertion in a wellbore together with a tubing string, the tightener comprising:

a mandrel adapted for connection to at least an upper section of tubing by attachment of the mandrel to a lower end of the tubing section, to secure the mandrel for axial and rotational movement with the tubing string and enable the tightener to be rotated between an unlocked and a locked position by manipulation of the tubing string;

a support member mounted upon the mandrel and freely rotatable thereabout, and means for restraining the support member from axial movement upon the mandrel;

a plurality of drag slips peripherally mounted upon the support member, the drag slips each having an outer surface comprising a slip surface region and a drag surface region which are selectively engageable with the wellbore and, located intermediate these regions, a region of contact between the drag slip surface and the wellbore in both the locked and unlocked conditions of the tightener;

means biasing the slip surface regions inwardly towards the mandrel and the drag surface regions outwardly towards the wellbore with sufficient force that, in the unlocked position of the tightener, the drag surface regions frictionally engage the wellbore and restrain relative rotational movement between the drag slips and the wellbore whilst still permitting axial movement of the tubing string; and a plurality of booster subs supported by and rotatable with the mandrel, each booster sub having side edges extending axially of the mandrel and a wedge profile in cross-section from one side edge to the opposite side edge forming an outwardly facing ramped surface adapted for selective engagement with a first rear surface region of the drag slip behind the slip surface region upon rotation of said mandrel;

each booster sub being rotatable with the mandrel from the unlocked position of the tightener to its locked position whereupon the ramped surface moves into engagement with the first rear surface region of the drag slip and progressively forces the first rear surface region outwardly to cause the drag slip to rock about the region of contact between the drag slip surface and the wellbore to retract the drag surface region and advance the slip surface region until the slip surface region engages the wellbore with sufficient force to prevent relative movement between the drag slip and the wellbore; and the booster sub being rotatable with the mandrel from the locked position of the tightener to its unlocked position to disengage the ramped surface from the the drag slip to allow the drag slip to rock in the opposite direction under the influence of the biasing means to retract-the slip surface region and advance the drag surface region.

Preferably, three or more drag slips are employed and the drag surface regions are substantially smooth, whilst the slip surface regions are serrated with teeth extending parallel to the axis of the wellbore.

The invention will hereinafter be described further by way of example only and by reference to the accompanying drawings.

DESCRIPTION OF THE PREFERRED EMBODIMENTS

Figure 1:
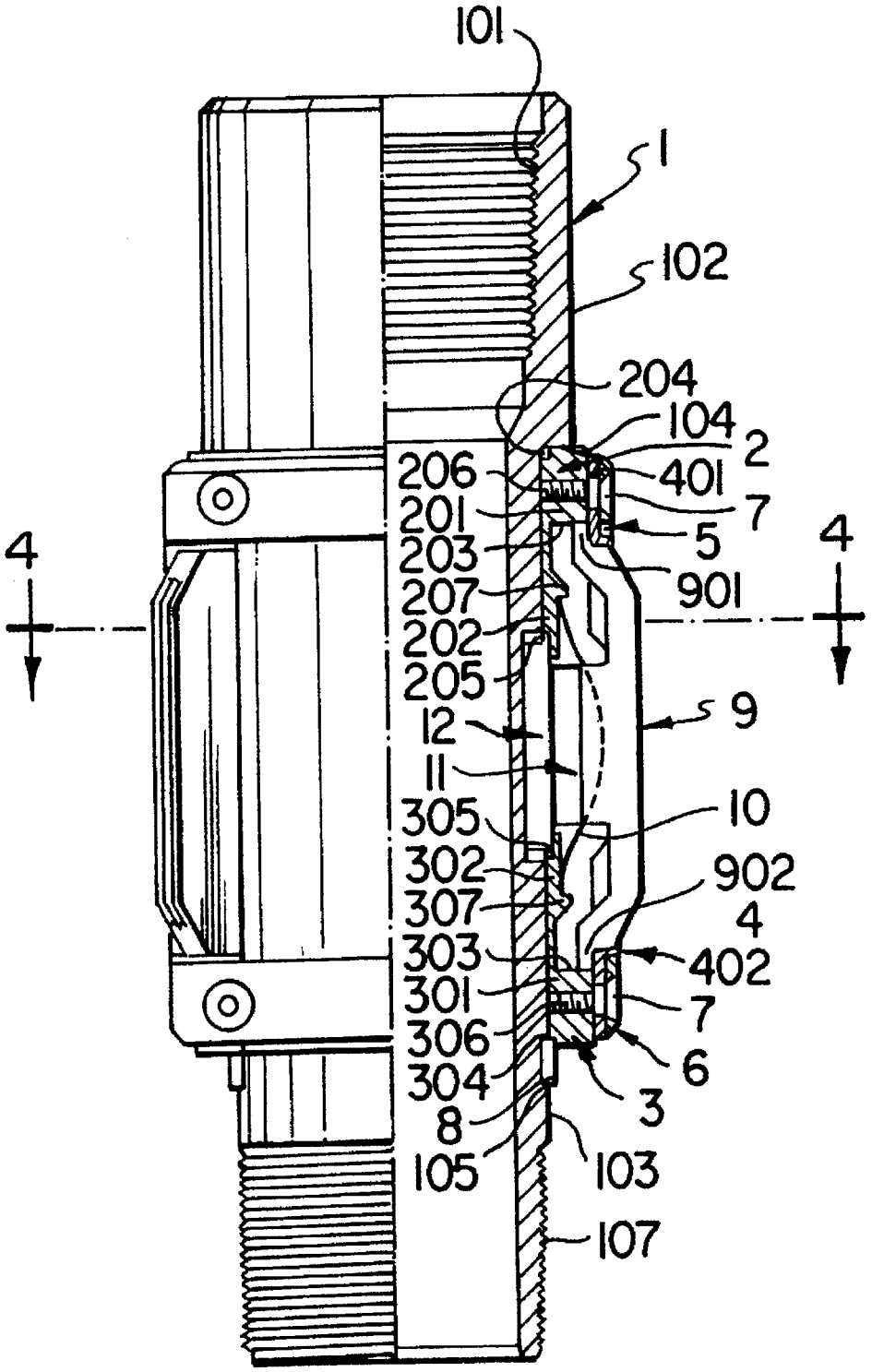
FIG. 1 is a side elevation, partly in cross-section, of a tubing tightener according to a preferred embodiment of the invention.
Figure 2:
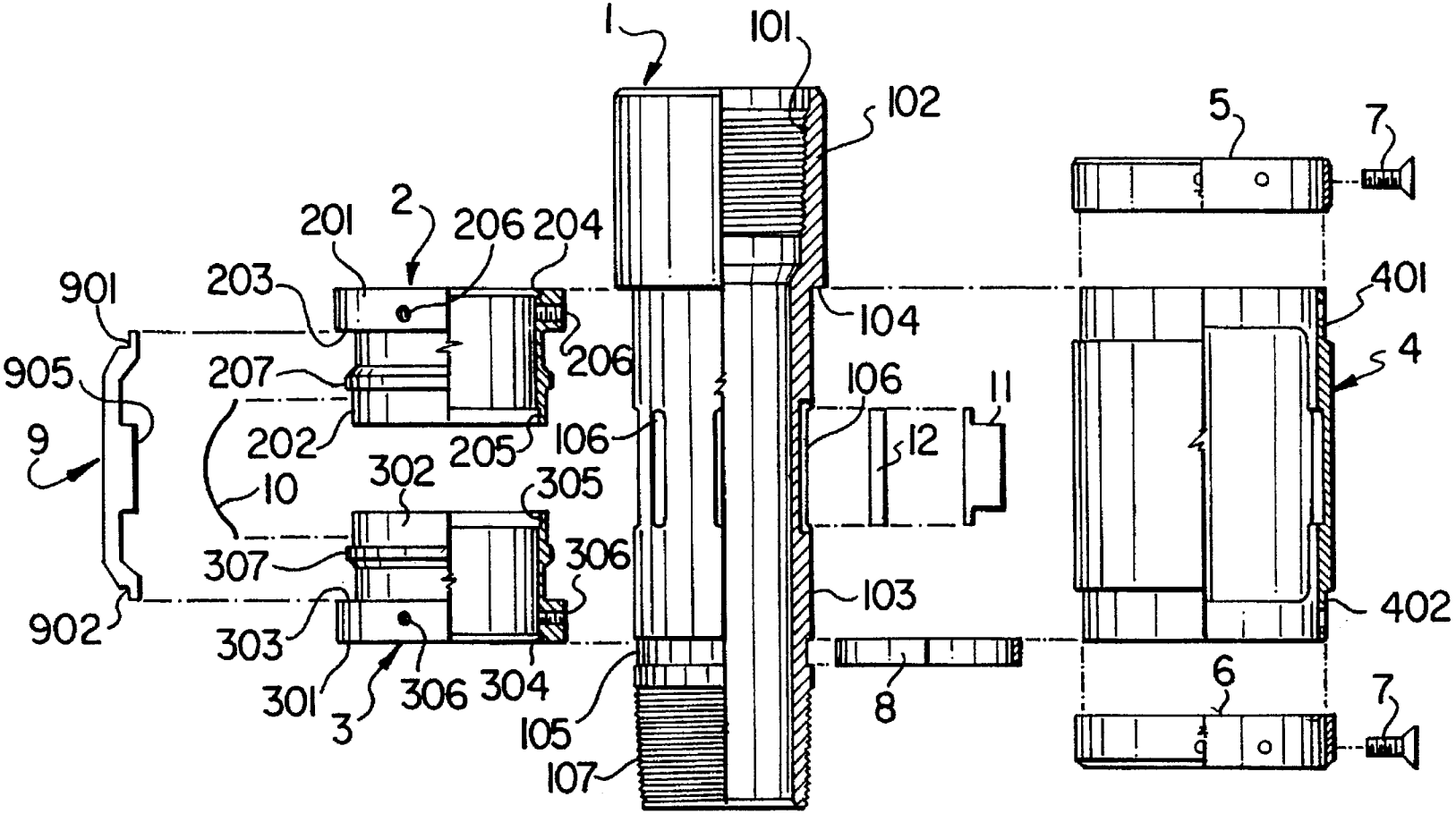
FIG. 2 is an exploded view of the embodiment of FIG. 1.

Turning now to FIGS. 1 and 2 of the drawings, the tubing tightener is located in a tubing string (not shown) by means of a mandrel 1. The mandrel has an upper region 102, provided with female threads 101 which engage with complementary male threads on an upper section of tubing, and a lower region 103 provided with male threads 107 which engage with complementary female threads on a lower section of tubing. The lower region 103 is of reduced external diameter relative to the upper region 102 and is connected to the upper region through a shoulder 104.

A cage assembly is mounted on the mandrel 1 and comprises a combination of first and second sleeves 2 and 3 supporting a cage 4 therebetween and first and second collars 5 and 6 respectively securing the cage 4 to the sleeves 2 and 3.

The first sleeve 2 is slidably and rotably located on the lower region 103 of the mandrel, the sleeve having upper and lower regions 201 and 202, the latter being of reduced external diameter and connected to the upper region through a peripherally extending shoulder 203. Two peripherally extending shoulder regions 204 and 205 are formed internally of the sleeve 2 at its upper and lower ends, respectively, for purposes which will hereinafter become apparent. The second sleeve 3, of identical construction to sleeve 2, is slidably and rotatably located on the region 103 of the mandrel 1, but is inverted so that upper and lower regions 302 and 301 correspond to upper and lower regions 201 and 202 of sleeve 2. Shoulder regions 304 and 305 correspond to regions 204 and 205 of sleeve 2 and shoulder 303 corresponds to shoulder 203.

Extending between sleeves 2 and 3 is the cylindrical cage 4, the end regions 401 and 402 of which fit snugly over the sleeve regions 201 and 301. The external surfaces of end regions 401 and 402 have peripherally extending shoulder regions, which respectively acommodate collars 5 and 6. The cage 4 is secured to the sleeves 2 and 3 by means of set screws 7 which pass radially through collars 5 and 6 and the respective end regions 401 and 402 and engage with threaded radial bores 206 and 306 in the respective sleeve regions 201 and 301. Thus, together with sleeves 2 and 3 and collars 5 and 6, the cage 4 forms a cage assembly which is both slidably and rotatably mounted on the reduced diameter region 103 of the mandrel 1.

The mandrel region 103 has a peripheral groove 105 which receives a ring 8, which axially locates the cage assembly on the mandrel whilst permitting it to freely rotate.

Figure 3:
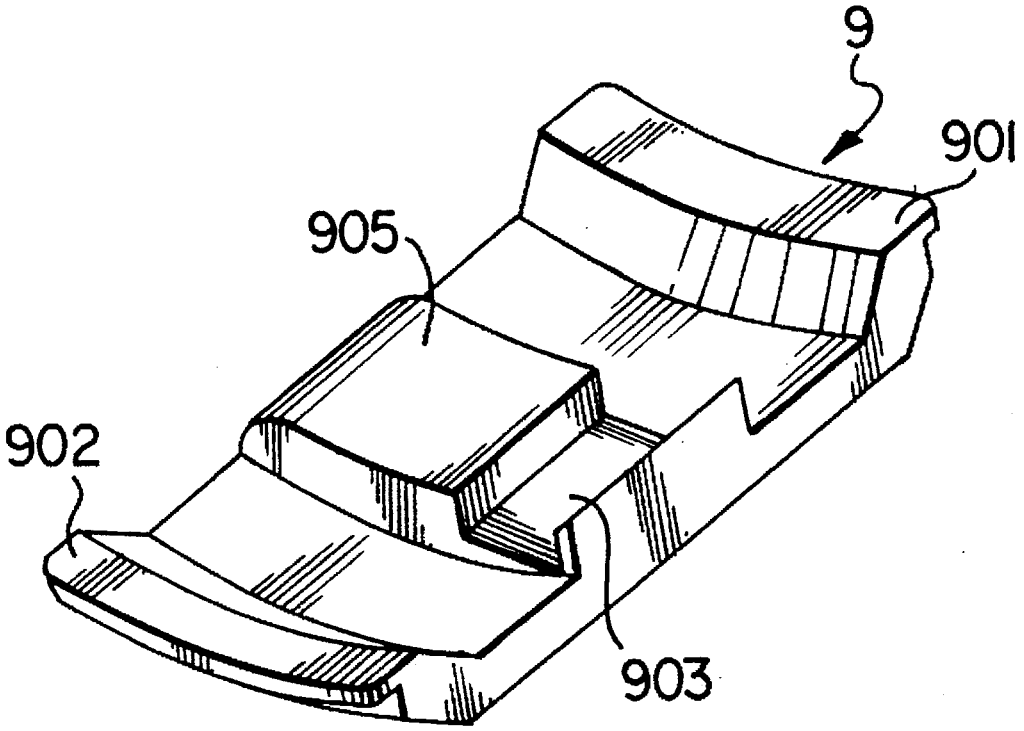
FIG. 3 is a perspective view of a drag slip employed in the embodiment of FIGS. 1 and 2.

The cage 4 has three circumferentially equispaced openings and located within the cage and projecting radially through the respective openings are three identical drag slips 9. Each drag slip is elongated in the vertical direction and arcuate in cross-section and is provided with upper and lower flanges 901 and 902 which abut the inner surface of the cage 4 to limit the extent of outward movement of the drag slips. Each drag slip is urged outwardly by a flat spring 10, which projects into a recess 903 in the rear surface of the drag slip (see FIG. 3) and the ends of which abut the sleeves 2 and 3 and are retained by flanges 207 and 307 formed peripherally about the respective sleeves. Thus, the equidistantly spaced drag slips impose a degree of centering action upon the tubing string as they are urged outwardly against the wellbore.

Figure 4A:
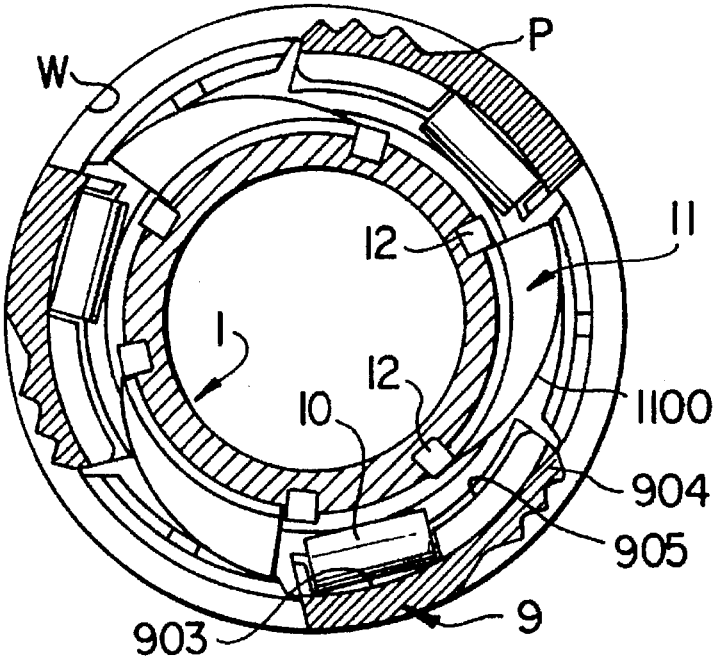
FIGS. 4A and 4B are top views of the embodiment of FIGS. 1 and 2, showing the tubing tightener in its unlocked and locked orientations, respectively.
Figure 4B:
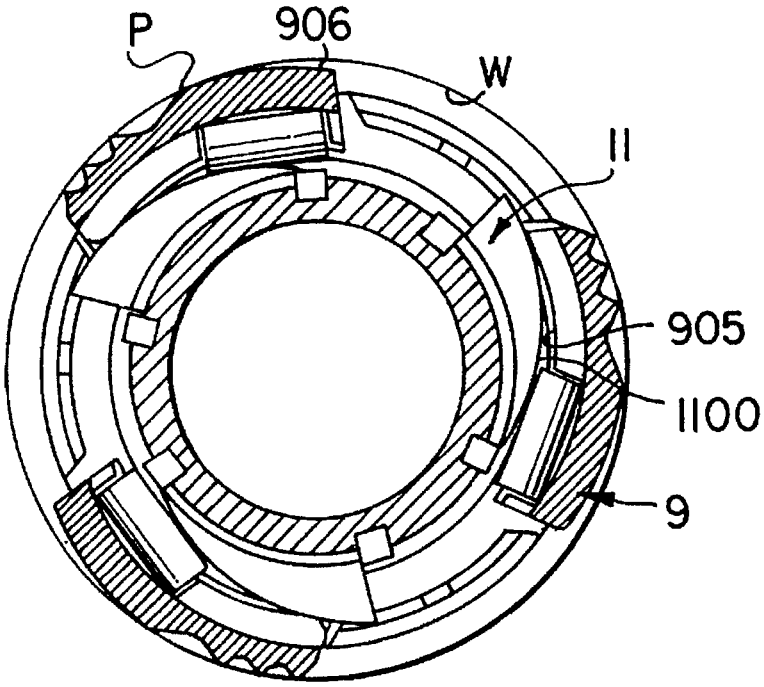

Referring to FIGS. 4A and 4B, the drag slips are each provided with vertically extending teeth 904 over their slip surface regions. The drag surface region 906 which is biased against the interior surface W of the wellbore by the associated spring 10, however, is substantially smooth. The drag surface region 906 frictionally engages the wellbore and provides control of the tubing string by restraining the drag slips from turning whilst still permitting axial movement of the tubing string. In order to positively force the teeth into engagement with the wellbore and effectively lock the tubing string in place, each drag slip is provided with a booster sub 11 which is both arcuate and wedge shaped in cross-section to provide a ramped surface 1100. The booster subs are rotationally keyed to the mandrel 1 by means of keys 12 which are located in vertical equispaced slots 106 formed in the mandrel region 103 and extend sufficiently outwardly to engage the side edges of the booster subs. The subs are also held in place by flanges 1101 formed at their upper and lower ends and which are retained within the shoulder regions 205 and 305 of sleeves 2 and 3.

To assemble the tightener for use, the upper sleeve 2 is firstly placed on the lower end of the mandrel 1 and slid up into engagement with the shoulder 104. The keys 12 are then placed in the respective slots 106 and the subs 11 are positioned therebetween with their thin edges facing the-direction of rotation selected for setting or locking the tightener. The lower sleeve 3 is then placed on the lower end of the mandrel and slid up the mandrel until the ends of the keys 12 and the flanges 1101 of the booster subs 11 are retained within the shoulder regions 205 and 305 of sleeves 2 and 3. The springs 10 are then placed over the thin edges of the subs 11, with their ends engaging the flanges 207 and 307 of the sleeves 2 and 3. The ring 8 is then placed in position on the mandrel to hold the foregoing sub-assembly in place. The drag slips 9 are loosely placed in the cage 4 with their drag surface regions 906 leading in the clockwise direction and the cage is slid over the sleeves 2 and 3 and manipulated so that the springs 10 become positioned in the recessed rear surface regions 903 of the drag slips. The cage is then secured in place by the collars 5 and 6 and the set screws 7.

In a first rotational position of the tubing string shown in FIG. 4A, each booster sub is positioned with its ramped surface 1100 clear of the drag slip. In this position, the booster subs exert no outward force upon the drag slips and the tubing string can be moved up or down with only the drag imposed by the springs 10 urging the drag surface regions 906 into engagement with the wellbore. To force the teeth 904 into gripping engagement with the wellbore, it is necessary only to turn the tubing string in the appropriate direction (clockwise, in the present embodiment) to the position shown in FIG. 4B. The frictional engagement of the drag surface regions 906 with the wellbore under the outward bias of the springs 10 is sufficient to inhibit rotation of the drag slips and the cage assembly and cause the ramped surfaces 1100 of the booster subs to be moved into engagement with the corresponding rear surface regions 905 of the drag slips, which are directly behind the serrated slip surface region 904. As rotation of the tubing string continues, the ramped surfaces of the booster subs force the surface regions 905 outwardly, which causes each drag slip to rock about a region of contact P between the drag slip surface and the wellbore surface W, located intermediate the drag and slip surface regions. Continued rotation forces the teeth 904 into gripping engagement with the wellbore and the entire assembly, including the tubing string, is then locked in position. To unlock the tightener, it is necessary only to turn the string in the opposite direction, whereby the ramped surfaces 1100 of the booster subs are retracted from engagement with the surface regions 905 and the springs 10 rock the booster subs back into their initial positions with the slip surfaces retracted.

In the foregoing embodiment, the tightener is set by rotating the tubing string clockwise. It may be that for certain applications, the user requires the tightener to operate in the opposite direction- i.e. to be set and released by anti-clockwise and clockwise rotation, respectively. In order to reverse the direction, it is a simple matter to dissasemble the tightener in the reverse order of the above assembly procedure, invert the drag slips so that they face in the opposite direcion, invert each of the subs 11 so that they too face in the opposite direction, and reassemble. The tightener is now set by turning the tubing string in the anti-clockwise direction.

Thus, it will be apparent that by combining the drag blocks and the slips into integrally formed drag slips, and designing the drag slips, the cage and the booster subs for easy disassembly and reassembly with the components oriented in the opposite direction of operation, considerable advantages in terms of lower cost, weight and bulk and also flexibility of operation are realized.

Modifications and improvements to the preferred forms of the invention disclosed and described herein may occur to those skilled in the art, without departing from the spirit and scope of the invention which are limited only by the appended claims.

What is claimed is:

1. A tubing tightener adapted for insertion in a wellbore together with a tubing string, said tightener comprising:

a mandrel adapted for connection to at least an upper section of tubing in the tubing string by attachment of the mandrel to a lower end of said section, to secure the mandrel for axial and rotational movement with the tubing string and enable the tightener to be rotated between an unlocked and a locked position by manipulation of the tubing string;

a support member mounted upon the mandrel and freely rotatable thereabout, and means for restraining the support member from axial movement upon the mandrel;

a plurality of drag slips mounted upon the support member and spaced peripherally thereabout, the drag slips each having an outer surface comprising a slip surface region and a drag surface region which are selectively engageable with the wellbore and, located intermediate said regions, a region of contact between the drag slip surface and the wellbore in both the locked and unlocked conditions of the tightener;

means biasing the slip surface regions inwardly towards the mandrel and the drag surface regions outwardly towards the wellbore with sufficient force that, in the unlocked position of the tightener, the drag surface regions frictionally engage the wellbore and restrain relative rotational movement between the drag slips and the wellbore whilst still permitting axial movement of the tubing string; and a plurality of booster subs supported by and rotatable with the mandrel, each said booster sub having side edges extending axially of the mandrel and a wedge profile in cross-section from one side edge to the opposite side edge forming an outwardly facing ramped surface adapted for selective engagement with a first rear surface region of the drag slip behind the slip surface region upon rotation of said mandrel;

each booster sub being rotatable with the mandrel upon rotation thereof from the unlocked position of the tightener to its locked position whereupon said ramped surface is moved into engagement with said first rear surface region of the drag slip and progressively forces said first rear surface region outwardly to cause the drag slip to rock about the region of contact between the drag slip surface and the wellbore to retract the drag surface region and advance the slip surface region until the slip surface region engages the wellbore with sufficient force to prevent relative movement between the drag slip and the wellbore; and each booster sub being rotatable with the mandrel upon rotation thereof from the locked position of the tightener to its unlocked position to disengage the ramped surface from the drag slip to allow the drag slip to rock in the opposite direction under the influence of said biasing means to retract the slip surface region and advance the drag surface region.

2. A tubing tightener as defined in claim 1, comprising at least three said drag slips.

3. A tubing tightener as defined in claim 2, wherein each said slip surface region is provided with teeth extending in the axial direction of said wellbore for gripping said wellbore.

4. A tubing tightener as defined in claim 3, wherein each said drag slip has a second rear surface region located behind said drag surface region, said second rear surface region engaged by said biasing means.

5. A tubing tightener as defined in claim 1, wherein said support member is in the form of a cylindrical cage assembly having a series of peripherally spaced openings through which said drag slips project radially outwardly.

6. A tubing tightener as defined in claim 5, wherein said cage assembly comprises upper and lower sleeve members rotatably mounted on said mandrel and a cage member secured to said sleeve members and extending therebetween.

7. A tubing tightener as defined in claim 6, wherein:

said upper sleeve member comprises upper and lower sleeve sections, said lower section extending downwardly inside said cage member, and said lower sleeve member comprises upper and lower sleeve sections, said upper section extending upwardly inside said cage member, said upper section of said lower sleeve member and said lower section of said upper sleeve member each being provided with an outwardly extending peripheral flange; and said biasing means for each said drag slip comprises a flat spring having ends thereof captured between said flanges and a central region bowed outwardly into abutment with said drag slip second rear surface region.

8. A tubing tightener as defined in claim 7, wherein:

each said drag slip has upper and lower ends respectively provided with arcuate flanges which extend upwardly and downwardly behind upper and lower edges of the cage openings, respectively, and prevent separation of said drag slip from said cage.

9. A tubing tightener as defined in claim 8, wherein:

each said booster sub is keyed for rotation with said mandrel by means of key members projecting outwardly from axially extending slots in said mandrel and retaining therebetween said side edges of said booster sub.

10. A tubing tightener as defined in claim 9, wherein:

said drag slips and said booster subs co-operate for locking said tightener in a first selected direction of rotation of said tubing string;

said cage member is removably secured to said sleeve members; and said booster subs are removable from said mandrel and said drag slips are removable from said cage assembly, upon detachment of said cage member from said sleeve members, and are reversible to permit rettachment of said cage member to said sleeve members with said drag slips and said booster subs co-operating to lock said tightener upon rotation of said tubing string in the opposite direction.

11. A tubing tightener adapted for insertion in a wellbore together with a tubing string, said tightener comprising:

a mandrel adapted for connection to at least an upper section of tubing in the tubing string by attachment of the mandrel to a lower end of said section, to secure the mandrel for axial and rotational movement with the tubing string and enable the tightener to be rotated between an unlocked and a locked position by manipulation of the tubing string;

a support member mounted upon the mandrel and freely rotatable thereabout, and means for restraining the support member from axial movement upon the mandrel, said support member comprising a cylindrical cage assembly having a series of peripherally spaced openings;

a plurality of drag slips mounted upon said cylindrical cage assembly and projecting radially outwardly through said openings, the drag slips each having an outer surface comprising a drag surface region and a serrated slip surface region, said surface regions being selectively engageable with the wellbore and, located intermediate said regions, a region of contact between the drag slip surface and the wellbore in both the locked and unlocked conditions of the tightener;

a plurality of booster subs supported by and rotatable with the mandrel, each said booster sub having side edges extending axially of the mandrel and a wedge profile in cross-section from one side edge to the opposite side edge forming an outwardly facing ramped surface adapted for selective engagement with a first rear surface region of the drag slip behind the slip surface region upon rotation of said mandrel; and spring means engaging a second rear surface region of each said drag slip behind the drag surface region, said spring means biasing the drag surface regions outwardly towards the wellbore with sufficient force that, in the unlocked position of the tightener, the drag surface regions frictionally engage the wellbore and restrain relative rotational movement between the drag slips and the wellbore whilst still permitting axial movement of the tubing string;

each booster sub being rotatable with the mandrel from the unlocked position of the tightener to its locked position whereupon said ramped surface moves into engagement with said first rear surface region of the drag slip and progressively forces said first rear surface region outwardly to cause the drag slip to rock about the region of contact between the drag slip surface and the wellbore to retract the drag surface region and advance the slip surface region until the slip surface region engages the wellbore with sufficient force to prevent relative movement between the drag slip and the wellbore; and each booster sub being rotatable with the mandrel from the locked position of the tightener to its unlocked position to disengage the ramped surface from the the drag slip to allow the drag slip to rock in the opposite direction under the influence of said biasing means to retract the slip surface region and advance the drag surface region.

12. A tubing tightener as defined in claim 11, comprising at least three said drag slips.

13. A tubing tightener as defined in claim 12, wherein each said slip surface region is serrated to form a plurality of teeth extending in the axial direction of said wellbore for gripping said wellbore.

14. A tubing tightener as defined in claim 13, wherein said cage assembly comprises upper and lower sleeve members rotatably mounted on said mandrel and a cage member secured to said sleeve members and extending therebetween.

15. A tubing tightener as defined in claim 14, wherein:

said upper sleeve member comprises upper and lower sleeve sections, said lower section extending downwardly inside said cage member, and said lower sleeve member comprises upper and lower sleeve sections, said upper section extending upwardly inside said cage member, said upper section of said lower sleeve member and said lower section of said upper sleeve member each being provided with an outwardly extending peripheral flange; and said spring means for each said drag slip comprises a flat spring having ends thereof captured between said flanges and a central region bowed outwardly into abutment with said drag slip rear surface.

16. A tubing tightener as defined in claim 15, wherein:

each said drag slip has upper and lower ends respectively provided with arcuate flanges which extend upwardly and downwardly behind the upper and lower edges of the cage openings and prevent separation of said drag slip from said cage.

17. A tubing tightener as defined in claim 16, wherein:

each said booster sub is keyed for rotation with said mandrel by means of key members projecting outwardly from axially extending slots in said mandrel and retaining therebetween said side edges of said booster sub.

18. A tubing tightener as defined in claim 17, wherein:

said drag slips and said booster subs co-operate for locking said tightener in a first selected direction of rotation of said tubing string;

said cage member is removably secured to said sleeve members; and said booster subs are removable from said mandrel and said drag slips are removable from said cage assembly, upon detachment of said cage member from said sleeve members, and are reversible to permit rettachment of said cage member to said sleeve members with said drag slips and said booster subs co-operating to lock said tightener upon rotation of said tubing string in the opposite direction.

* * * * *